United States Patent [19]

Rudenauer et al.

[11] 3,954,061

[45] May 4, 1976

[54] SAFETY DEVICE ON ELECTRIC PROJECTILE FUSES

[75] Inventors: Werner Rüdenauer, Roth; Peter F. Weidner, Nurnberg; Dietmar Stutzle, Lauf, all of Germany

[73] Assignee: Diehl, 85 Nurnberg, Germany

[22] Filed: June 11, 1974

[21] Appl. No.: 478,281

[30] Foreign Application Priority Data

June 13, 1973 Germany ..... 2330013

[52] U.S. Cl. ..... 102/70.2 GA; 102/70.2 R; 102/79

[51] Int. Cl.[2] ..... F42C 11/02; F42C 15/22

[58] Field of Search ..... 102/70.2 R, 70.2 GA, 102/79

[56] References Cited

UNITED STATES PATENTS

| | | | |
|---|---|---|---|
| 2,419,828 | 4/1947 | Ferris | 102/70.2 R |
| 2,750,889 | 6/1956 | Kuhn | 102/79 |
| 2,870,712 | 1/1959 | Brown et al. | 102/70.2 GA |
| 3,030,886 | 4/1962 | Junghans et al. | 102/79 |

FOREIGN PATENTS OR APPLICATIONS

| | | | |
|---|---|---|---|
| 1,159,841 | 2/1958 | France | 102/79 |

*Primary Examiner*—Charles T. Jordan
*Attorney, Agent, or Firm*—Walter Becker

[57] ABSTRACT

A safety device for an electrically operable projectile fuse in which a primer pin in the form of a firing pin is axially displaceable in the projectile while a detonator cap near one end of the primer pin is adapted to be ignited by impact of the primer pin thereon. A spring biases the primer pin away from the detonator cap while a propelling charge near the other end of the primer pin is electrically ignitable to drive the primer pin into impact with the detonator cap. The primer pin is latched in the projectile with the spring compressed and rotation of the projectile in flight will release the latch. When the primer pin is released it bridges a pair of contacts and completes a circuit from a piezo electric crystal through the propelling charge whereby the projectile will detonate upon impact by igniting the propelling charge and driving the primer pin into impact with the detonator cap. The detonator cap moves into registration with the primer pin in response to rotation of the projectile in flight.

10 Claims, 3 Drawing Figures

SAFETY DEVICE ON ELECTRIC PROJECTILE FUSES

The present invention relates to a safety device on electric projectile fuses which includes a primer pin axially displaceable in the fuse, a rotor locked by means of said primer pin in its safe position and equipped with a detonator cap adapted to be initiated by the primer pin, and also equipped with an electric energy source adapted to be connected to the igniting means.

With electric fuses, for purposes of obtaining the necessary safety in the input tube in addition to electric charging and electronic circuits, also mechanical control means are known by which through the intervention of retarders enter in a delayed action into the turning-on position. Such mechanical switches may be actuated for instance by a rotor pivotable into armed position.

With small caliber projectiles, this solution, however, is either not possible at all or only under great difficulties, in view of the limited space conditions, especially since the contacts have to be insulated and the feeding lines have to extend to the rotor.

It is, therefore, an object of the present invention to provide a safety device on electric projectile fuses of the above mentioned general type, and more specifically to provide a mechanical switch in the fuse, especially of small caliber projectiles, which closes the igniting circuit in a delayed action, while, however, hardly any additional space is required, short connecting lines will be possible, and while said mechanical switch will practically be independent of the influence of the rotation of the projectile and after the mechanical switch has been turned on, a later opening of the switch prior to the ignition will be safely prevented.

It is another object of this invention to provide an arrangement as set forth in the preceding paragraph which will safely prevent trajectory explosions, even if an error or a fault should have occurred in the electric or electronic structural elements.

These and other objects and advantages of the invention will appear more clearly from the following specification in connection with the accompanying drawing, in which.

The safety device according to the present invention is characterized primarily by a contact switch associated with the primer pin, which contact switch includes contact tongues adapted to be bridged by the primer pin which springs into the armed position while the primer pin primarily itself forms the contact bridge which is adapted by means of the contact tongues resting in a spreading position against the shank of the primer pin to be arrested in the closing position of the contact switch.

The primer pin may have associated therewith an electrically ignitable propellant charge which serves as pushing-in force and is arranged in the fuse housing above the contact switch. This propellant charge comprises a flash cap and may be associated with a gas pressure charge so that when said gas pressure charge is ignited, the primer pin will forcibly destroy the self-locking of the contact switch and will be adapted to be pushed into the detonator cap of the rotor which latter is pivoted into igniting position only after the contact switch has closed. The elastic contact tongues may be provided in contact plates which are insulated from each other and may in a spoke-like manner be arranged axially one above the other.

For purposes of closing said contact there will thus serve the primer pin which is provided anyhow, and as closing movement there will serve the arming movement of said primer pin. In addition to the contact plates which are insulated from each other and which support the contact tongues, no additional electric contact structural elements are necessary. The primer pin itself will serve as contact bridge.

In this way a low structural height, independent of foreign influences such as twists, and a safe locking of the contact switch in its closing position will be assured. This closing position is disengaged by destruction only after ignition has taken place, which means at a time at which the contact switch has carried out its function. Since the giving of the contact is effected prior to the rotor reaching its armed position, it will be appreciated that with errors in the electric or electronic part of the fuse, for instance in view of a premature application of the ignition voltage, at the worst a failure of the fuse could occur.

Figure 1:
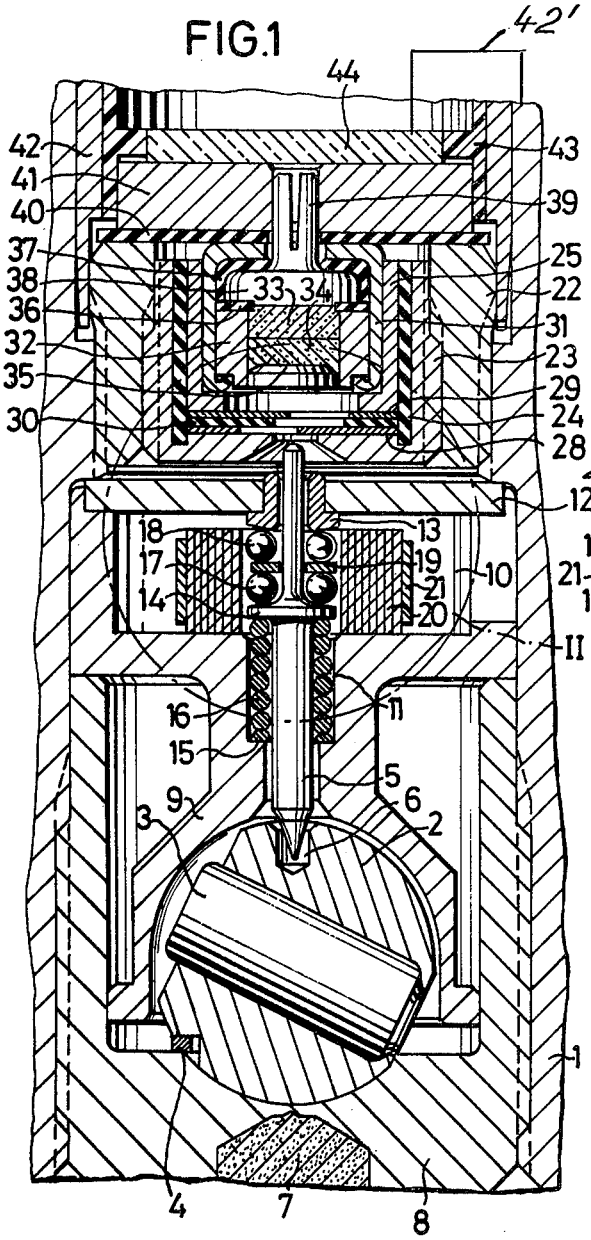
FIG. 1 illustrates a longitudinal section through that portion of an electric projectile fuse in safe position which is important for the present invention.

Referring now to the drawing in detail, and FIG. 1 thereof in particular, it will be seen that a rotor 2 is mounted in the rear portion of an ignition housng 1 of which only a section is shown. The rotor 2 is provided with a detonator cap 3. In the illustrated safe position of the fuse, the detonator cap 3 is pivoted outwardly and the rotor 2 is held in safe position on one hand by a centrifugal element 4 which is pivotable outwardly by the twist when a shot is fired and on the other hand by the tip of a primer pin 5 which immerses into a bore 6 of the rotor 2. A detonator charge 7 adapted to be initiated by the detonator cap 3 is arranged adjacent the rotor 2. The detonator charge 7 is provided in a detonator support 8. The rotor 2 is held in a front portion by an insert 9 which in its upper section has a recess 10 and centrally has a stepped bore 11 in which the primer pin 5 is guided. The insert 9 is closed by a plate 12 which is equipped with a central bushing 13 in which the primer pin 5 is axially displaceable. Between a widened dish 14 of the primer pin 5 and a step 15 of the insert 9 there is tensioned a compression spring 16 which continuously urges the primer pin 5 in the upward direction. This spring 16, however, is prevented from doing so by a ball locking mechanism which comprises two layers of balls 17, 18 separated from each other by a disc 19, and an escape spiral 20 extending around said balls. The balls 17 engage the dish 14 whereas the balls 18 engage the bushing 13. The spiral 20 when in rest position is held closed by a spring clamp 21.

An intermediate sleeve 25 of metal which opens in the downward direction, i.e., toward the primer pin 5, is provided in the upper and front portion of the fuse housing 1, and more specifically within a receiving part 22 and a holding ring 23. An intermediate sleeve 25 of metal is separated from said holding ring 23 by an insulated tube 24. The intermediate sleeve 25 of metal opens in the downward direction, i.e., toward the primer pin 5. The upper portion of the primer pin 5 forms a contact pin which cooperates with contact tongues 26, 27 (FIG. 3) of contact plates 28, 29 when the primer pin 5 is pushed upwardly by spring 16. The lower contact plate 28 engages the metallic holding ring 23. The second contact plate 29 is separated from the above mentioned contact plate 28 by means of an insulating disc 30 but on the other hand rests against the intermediate sleeve 25. The intermediate sleeve 25 serves as receiving means for detonator cap mantle 31 in which, held by a fitting ring 32, an electrically ignitable flame charge 33 is provided and a gas pressure charge 34 is axially adjacent to said flame charge. The gas pressure charge 34 is at its lower part closed by a cup 35 for instance of combustible material which melts in view of developing heat. At the top, the flame charge 33 is axially fixed by an insulating disc 36 and a sleeve 37 of insulating material which sleeve surrounds a contact body 38. The contact body 38 engaging the flame capsule 33 projects by means of a plug pin 39 through an insulating plate 40 into a contact plate 41 which by means of a connecting sleeve 42 and an insulating sleeve 43 is coaxially fastened in the ignition body 1 and serves as impact plate for a Piezo cell 44 resting thereon. In said Piezo cell, the charge required for igniting the electric flash cap 33 will be generated in a well-known manner for instance in response to the impact at the target.

When a projectile is fired under twist by a fuse according to FIG. 1, first the centrifugal member 4 is disengaged and releases the rotor 2. As soon as the acceleration of the projectile stops, the spring clamp 21 and the centrifugal spiral 20 open under the effect of the rotation of the projectile and engage the outer wall of the recess 10. As a result thereof, the balls 17, 18 fly outwardly under the influence of the centrifugal force. In this way, they release the primer pin 5 through the intervention of the dish 14. The primer pin 5 is pushed upwardly by the electrical pressure spring 16. In this connection the upper end of the primer pin 5 which is designed as the contact pin pierces the contact plates 28 and 29 and bridges the same through the intervention of the contact tongues 26, 27 thereof. Due to the axial displacement of the primer pin 5, also the tip at the lower end of said primer pin is pulled out of the bore 6 whereby the rotor 2 is freed. Thus, the primer pin is unlatched only after the projectile has left the barrel.

Due to the effect exerted by the twist of the projectile, rotor 2 is placed into upright position which means it is tilted in such a way that the detonator cap 3 wll be in alignment with and below the tip of the primer pin 5. The fuse is now armed. It may be added that rotor 2 is aligned to respond to centrifugal forces developed by rotation of the projectile. Presumably, rotor 2 could be spring urged toward firing position.

The arm elements described in connection with FIG. 1 as well as the contact switch now occupy the position shown in FIG. 2. The inner ends of the contact tongues 26, 27 on the contact plates 28, 29 engage the contact pin of the primer pin 5 which means that they spread at said contact pin so that the primer pin 5 can leave its FIG. 2 position only when destroying the contact elements.

Figure 2:
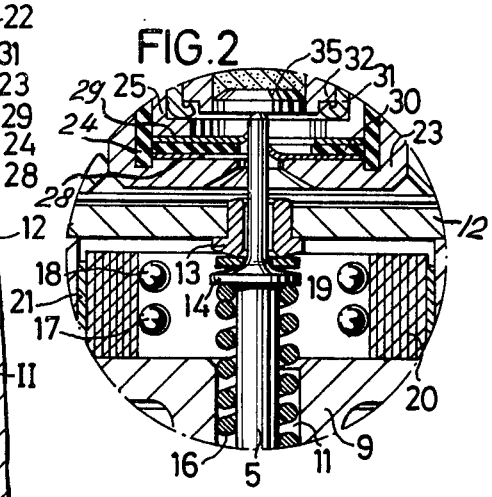
FIG. 2 shows that portion of FIG. 1 which is encircled by a dot-dash circle but illustrates the respective parts in armed condition, i.e., igniting position.
Figure 3:
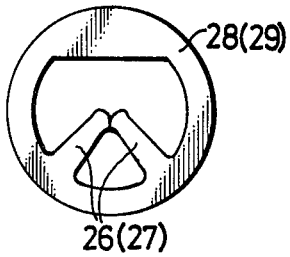
FIG. 3 is a top view of a plate shown in the upper portion of FIGS. 1 and 2.

If now the projectile with the fuse according to FIGS. 1–3 hits the target, it will be appreciated that in a manner known per se in the Piezo cell 44 the electric charge is generated which is required for igniting the flash cap 33. A negative voltage is applied to the housing 42 via electrical connection 42', which voltage passes through the part 22 and holding ring 23 to the contact plate 28 and from the latter through the contact tongues 26,27 (FIG. 3), the primer pin 5 and the contact plates 29 through the intermediate sleeve 25, detonator cap mantle 31 and ring 32 passes to one pole of the flash cap 33. On the other hand, the plus voltage passes through contact plate 41, plug 39 and contact body 38 to the other pole of the flash cap 33. The flash cap 33 is ignited and fires up or ignites the gas pressure charge 34. The thus created pressure destroys the contact switch 26–29 and shoots the bushing 13 together with the primer pin 5 downwardly (toward the rear) so that the tip of the primer pin 5 pierces the detonator cap 3 whereby the detonator charge 7 is initiated.

Inasmuch as the rotor 2 is pivoted only after the closure of the contact switch 26–29, it will be appreciated that in case of a fault in the electric part of the fuse, for instance a premature charge generation in the Piezo generator 4, the ignition of the flash cap 33 will occur prior to the fuse becoming armed. While this could cause a "dud" it could, under no circumstances destroy the barrel.

It is, of course, to be understood that the present invention is, by no means, limited to the specific showing in the drawing but also comprises any modifications within the scope of the appended claims.

What is claimed is:

1. In a fuse device for a projectile; a firing pin in the form of a primer pin axially displaceable in the projectile, a detonator cap near one end of the primer pin adapted to be ignited by impact of the primer pin thereon, a source of electrical energy, an electrically ignitable propelling charge at the other end of the primer pin operable when ignited to drive the primer pin into impact with said detonator cap, spaced electrical contacts between said source and said propelling charge adapted to be bridged by said primer pin, means biasing said primer pin toward contact bridging position, latch means normally holding said primer pin in spaced relation to said contacts, means responsive to rotation of the projectile when propelled from a barrel to disengage said latch means thereby to permit said primer pin to contact bridging position, and means operable upon impact of said projectile for actuating said source thereby to ignite said propelling charge.

2. A device according to claim 1 in which said contacts comprise spring fingers which engage said primer pin and are electrically interconnected by the primer pin, said spring fingers being deflected by movement of the primer pin into contact bridging position and locking said primer pin in contact bridging position until said propelling charge is ignited.

3. A device according to claim 2 in which said propelling charge is formed by a first charge in the form of a flash cap which is electrically ignited and a second charge in the form of a gas pressure developing charge and which is ignited by the flash cap.

4. A device according to claim 3 in which the gas pressure developed by the said second charge overcomes the locking effect of said spring fingers on said primer pin and drives said primer pin into impact with said detonator cap.

5. A device according to claim 1 in which each said contact is in the form of a washer-like element having at least one spring finger extending into the path taken by said primer pin when the primer pin is released from the latched position thereof.

6. A device according to claim 1 which includes a rotor in the projectile supporting said detonator cap, said rotor prior to discharge of the projectile from a barrel being rotated into a first position to displace said detonator cap from the path of said primer pin, rotation of said projectile when discharged from a barrel rotating said rotor into a second position to align said detonator cap with said primer pin.

7. A device according to claim 6 which includes a latch element between said rotor and projectile which holds said rotor in said first position, said latch element being displaced into noneffective position by said rotation of said projectile.

8. A device according to claim 6 in which said one end of said primer pin engages and holds said rotor in said first position thereof when said primer pin is in latched position.

9. A device according to claim 1 in which said latch means holding said primer pin in spaced relation to said contacts is held in latching condition in response to acceleration of the projectile along a barrel whereby said latch means becomes ineffective to latch said primer pin only after the projectile has left a barrel.

10. A device according to claim 1 in which said source of electricity is a piezo electric crystal means having one pole connected to one side of said propelling charge and the other pole connected to one of said contacts, the other of said contacts being connected to the other side of said propelling charge.

* * * * *